United States Patent [19]

Speck

[11] 3,977,027

[45] Aug. 31, 1976

[54] WATER CURRENT-PRODUCING APPARATUS

[76] Inventor: Willy Speck, Am Neubruch 27, D-8501 Behringersdorf, Germany

[22] Filed: May 20, 1974

[21] Appl. No.: 471,791

Related U.S. Application Data

[63] Continuation-in-part of Ser. No. 279,073, Aug. 9, 1972, abandoned.

[30] Foreign Application Priority Data

Feb. 25, 1972 Germany ..... 2209056

[52] U.S. Cl. ..... 4/172.16; 4/172.17; 128/66; 210/169

[51] Int. Cl.[2] ..... E04H 3/18

[58] Field of Search ..... 4/172.16, 172.15, 172.17, 4/178, 180; 210/169; 128/66

[56] References Cited

UNITED STATES PATENTS

| | | | |
|---|---|---|---|
| 3,287,741 | 11/1966 | Nash | 4/180 |
| 3,345,982 | 10/1967 | Guiler | 4/180 |
| 3,577,571 | 5/1971 | Bellinson et al. | 4/172.17 |
| 3,605,131 | 9/1971 | Brazel et al. | 4/172.16 |

*Primary Examiner*—Richard E. Aegerter
*Assistant Examiner*—Steven L. Stephan
*Attorney, Agent, or Firm*—Stewart and Kolasch, Ltd.

[57] ABSTRACT

An apparatus for producing a water current in a swimming pool which comprises an outer housing which is adapted to be attached to the wall of a swimming pool, said outer housing being provided with a suction nipple and a pressure nipple, a housing insert disposed within the outer housing and defining an annular intake space therebetween, partition means associated with the housing insert, said partition means subdividing the interior of said housing insert into a pressure chamber and a suction chamber, said pressure chamber containing a front wall and provided with at least one nozzle means disposed in said front wall, said pressure chamber being disposed between the pressure nipple and the nozzle means and cover plate means spaced apart from the front wall and covering the suction chamber on its front side, said cover plate means together with the side wall of the suction chamber defining an intake port in the sidewall of the suction chamber, said intake port providing communication between the annular intake space and the suction chamber.

11 Claims, 7 Drawing Figures

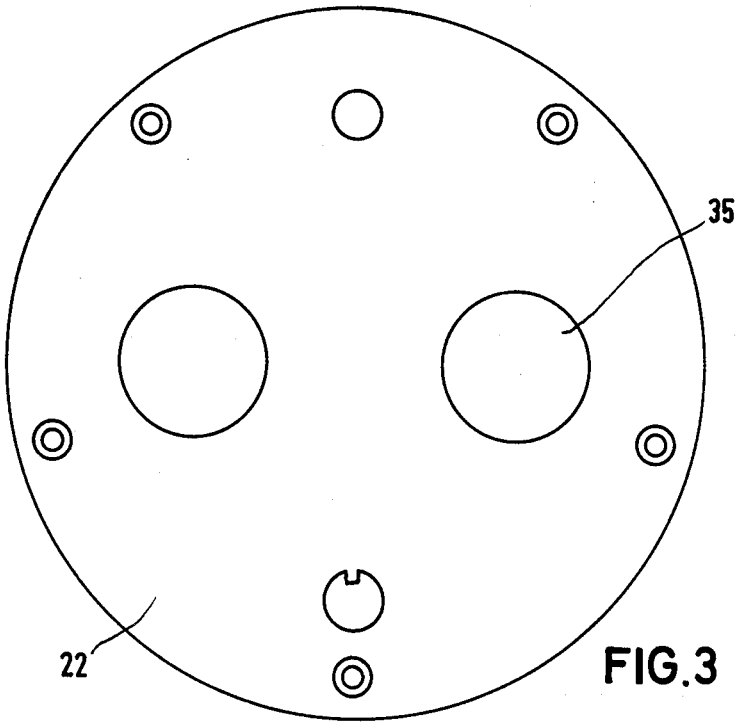
FIG.3
FIG. 4
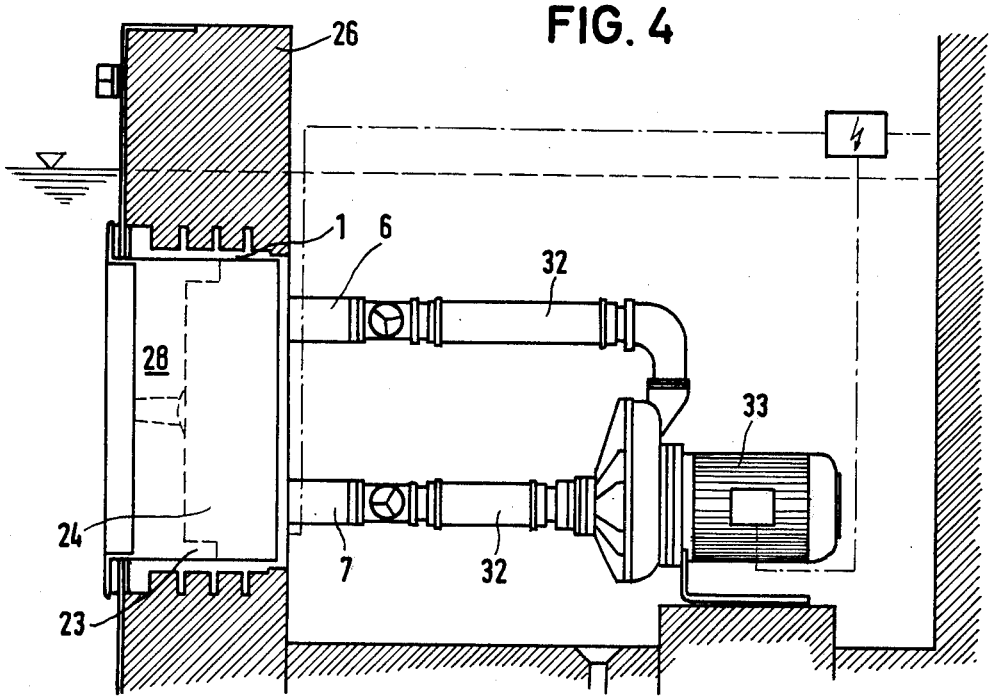

FIG. 6
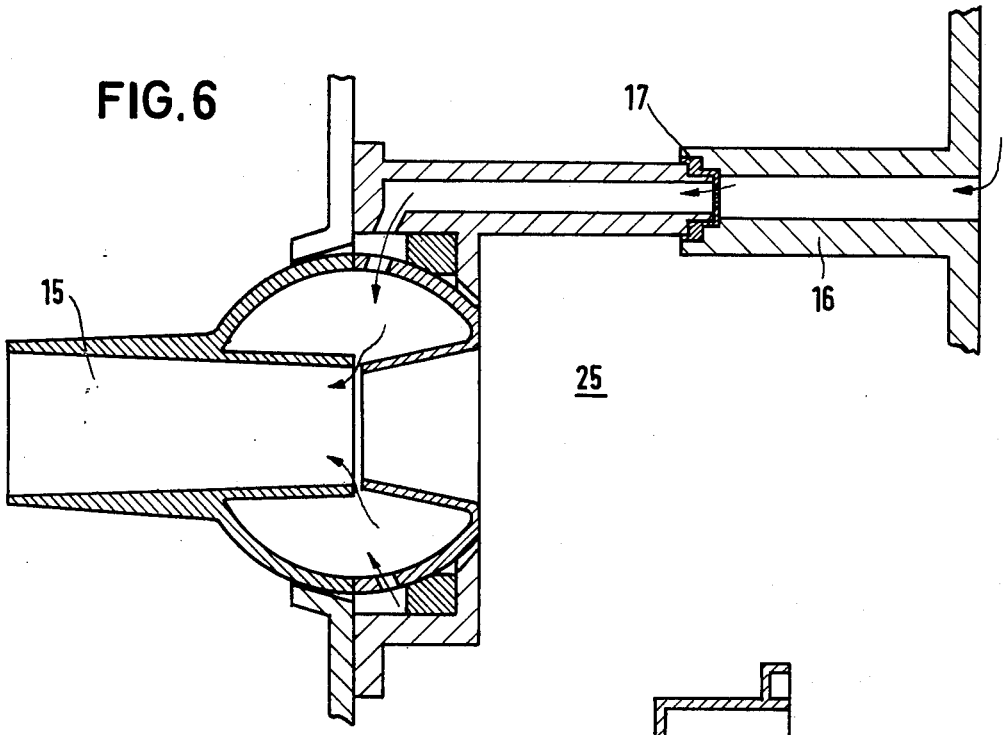
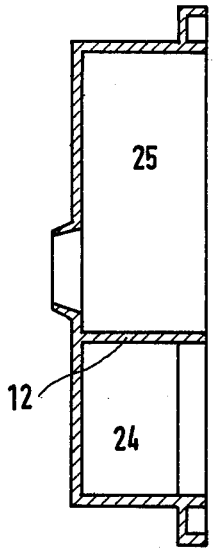
FIG. 7

WATER CURRENT-PRODUCING APPARATUS

BACKGROUND OF THE INVENTION

This is a continuation-in-part application of application Ser. No. 279,073, filed Aug. 9, 1972 and now abandoned.

The present invention relates to an apparatus for producing a water current in a swimming pool. More particularly, the present invention is directed to a suction port (intake duct) and at least one nozzle which terminates in the swimming pool and can be placed in communication with the suction side and the pressure side, respectively of a pump located outside of the water.

Devices have been known for producing a water current in a swimming pool wherein a water jet disposed beneath the water level exits from a nozzle in communication with the pressure (delivery) side of a pump. In these devices, the pump, provided with a suction filter, is combined with an underwater electric motor attached to a structural unit and enclosed by a common, water-tight housing. In this arrangement, a support girder is provided as the connecting member between the pressure side of the pump and the nozzle, wherein the nozzle is attached to the housing; see German Published Application 1,653,760.

Since the pump with the drive motor is arranged in the water of the swimming pool, the motor may only be operated with a weak current for safety reasons. Furthermore, due to the required watertight accommodation of the motor in the housing, a large constructional expenditure is necessary. In addition, such relatively voluminous assemblies in the interior of a swimming pool are highly undesirable.

Steps have also been taken to arrange the motor and the pump outside of the swimming pool, wherein the suction strainer is provided as a separate unit in the proximity of the bottom of the basin, and the nozzles in communication with the pressure connection (pressure-inlet nipple) of the pump are disposed underneath the water level; see German Published Application 1,684,909. This arrangement has the disadvantages that due to the greater water depth, sealing problems frequently occur on the suction side of the pump. Furthermore, an appropriate pump well must be provided outside of the swimming pool and also the mounting and arrangement of the assembly in the pool wall is very complicated.

In order to simplify the assembly, it is known to employ a mounting plate which is cemented into the wall of the swimming pool. In this mounting plate, in addition to the pressure connection for the nozzle, a suction pipe (nipple) for the intake of the water is likewise disposed at a distance from the pressure connection; see German Utility Model No. 1,964,441. In spite of this combination of suction pipe and pressure connection in one mounting plate, the disadvantage still remains that a pump well must be provided, just as in the above-described conventional apparatus. There is also the danger that the desired pressure flow from the nozzle is strongly affected by the suction current.

SUMMARY OF THE INVENTION

An object of the present invention is to provide an improved apparatus for producing a current in a liquid pool.

Another object of the present invention is to provide an improved apparatus for producing a water current in a swimming pool.

A further object of the present invention is to provide an improved apparatus for producing a water current in a swimming pool which has a compact construction and wherein the pressure flow is not influenced by the suction flow.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention it has been found that the above-mentioned disadvantages may be eliminated and a much improved apparatus for producing a water current in a swimming pool may be obtained by providing a single housing opened toward the swimming pool and containing a housing insert mounted therein. An intake chamber (space) is provided between the outer wall of the insert and the inner wall of the housing. By arranging a partition in the interior of the housing insert which subdivides said interior into a pressure chamber and a suction chamber, the pressure chamber is disposed between the delivery nipple of the pump and the nozzle provided in the front side of the pressure chamber. An intake opening terminating in the intake space is arranged in the sidewall of the suction chamber, the throughflow cross section of this opening being designed to provide for a hardly noticeable intake flow (current).

Advantageously, the housing is essentially cylindrical, and the housing insert is provided in the housing in such a manner that an annular intake space is formed, limited on the side opposite the swimming pool by an annular inner shoulder of the housing.

The housing insert is advantageously seated so deeply in the interior of the housing that the mouth of the nozzle projecting from the housing insert lies in one plane with the end rim of the housing being on the swimming pool side.

In addition to being limited by the partition, the suction chamber can be defined by a web on the front side which extends into a wall web lying in the imaginary wall plane of the housing insert and is attached to the inner shoulder of the housing.

In a particularly advantageous embodiment of the present invention, a cover plate surrounding the nozzle is disposed at a distance from the front side of the housing, said cover plate functioning to close off the suction chamber on the front side of the device.

In order to set the pressure flow, the orifice cross section of the pressure (discharge) nipple disposed at the housing on the side of the floor of the swimming pool is infinitely variable, but cannot be entirely sealed in order to avoid overheating of the pump. The adjustment is effected by means of a plate disposed opposite to the delivery nipple orifice, the spacing of this plate with respect to the orifice being variable by means of a threaded rod disposed in the front wall of the housing an extending through an opening in the cover plate. An adjusting knob is attached to this rod.

In order to avoid pressure losses on the pressure side, the pressure chamber is suitably larger than the suction chamber.

The possibilities of using the apparatus of the present invention are still further increased by arranging two spaced-apart nozzles at the pressure chamber of the housing insert, said nozzles being adapted to be operated selectively or together. A compressed-air line, sealingly extended through the pressure chamber, terminates in each nozzle. Furthermore, it is advantageous to arrange handles at the rim of the housing on the swimming pool side.

The apparatus of the present invention has the advantage that the built-in housing is made of corrosion-proof plastic and accordingly can be mounted in a submerged fashion which makes it suitable for all swimming pool constructions. The quantitative fine regulation of the nozzles makes it possible to adjust the flow individually. A switch mounted underneath the web can be operated from the swimming pool underwater, by means of a key or a push button attached to the cover plate. Similarly, the adjusting button for the fine regulation of the nozzles can be so adjusted. The switch operates with a weak current, so that no dangers are encountered. Also, the circuit elements of the switch are protected against damage. The apparatus can also be switched on and off additionally, or also alternatively, from outside of the swimming pool.

Due to the compressed-air line, the flow of water can have air simultaneously admixed thereto, whereby a health-promoting effect is attained. The nozzle or nozzles are directionally adjustable within certain limits and can also be connected to a massaging hose. By orienting the end of a hose joined to a nozzle toward the bottom of the pool, sediment can be removed therefrom by turbulence and fed to the filter in the recirculating plant.

The suction operation, which accommodates a very large cross section, takes place via an annular channel which is offset axially with respect to the mouth portion of the nozzles. The intake space terminates in the suction chamber which also has a very large cross section. Thus the velocity of the water flowing toward the intake space is so low that the pressure flow is not impaired. Furthermore, there are no locations with an excessive suction effect. The apparatus of the present invention can be installed in an effective and simple manner in the proximity of the upper rim of the pool in a sidewall. Due to the low ambient water pressure at this point, no sealing problems occur. The housing of the device can either be cemented directly into the wall of the pool or mounted on its wall. If, for example, the pool is made of plastic or if the inner pool wall consists of plastic sheets, the apparatus can be mounted to the wall by welding or gluing. Since the mouth portions of the nozzles are flush with the pool wall, the rim of the housing is also flush so that any danger of injury by projecting parts is eliminated.

DESCRIPTION OF THE DRAWINGS

The present invention will become more fully understood from the detailed description given hereinbelow and the accompanying drawings which are given by way of illustration only and thus are not limitative of the present invention and wherein.

FIG. 3 shows, in detail, the plate means spaced apart from the front wall of the housing insert;

FIG. 4 shows the relationship of the pump means with the pressure and suction nipples of the water current-producing device of the present invention;

FIG. 6 shows in greater detail the association of the nozzle with the compressed-air line; and FIG. 7 shows the relative sizes of the suction and pressure chambers.

DESCRIPTION OF THE PREFERRED EMBODIMENTS

Figure 2:
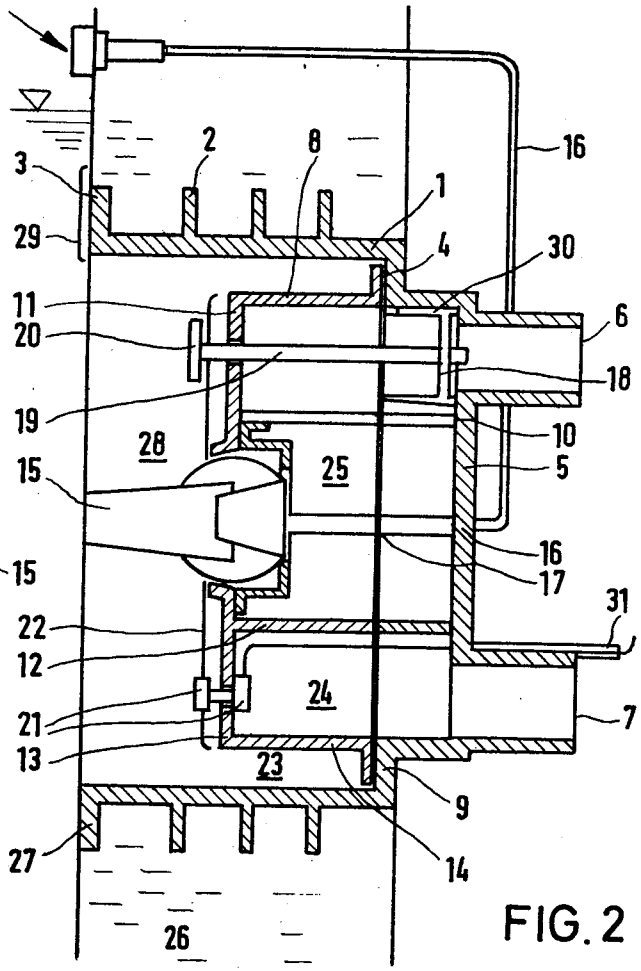
FIG. 2 shows a section along line II—II of FIG. 1.
Figure 1:
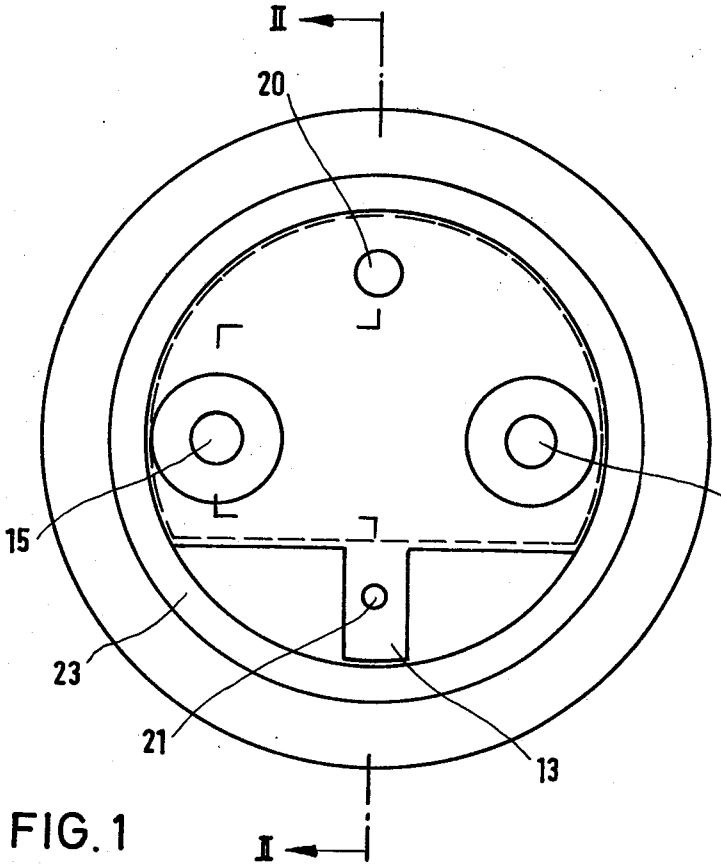
FIG. 1 shows a top (plan) view of the apparatus of the present invention wherein the cover plate has been omitted.

At a spacing from the flange 3, the housing 1 has an inner shoulder 4 which communicates with a bottom portion 5 via a cylindrical wall portion. In the bottom portion 5, a suction nipple 7 and a pressure nipple 6 are provided and conduit means 32, shown in detail in FIG. 4, are utilized for connecting the suction nipple and the pressure nipple to the suction side and pressure side, respectively, of a pump 33. The pump is utilized between the suction nipple and the pressure nipple for conveying the water in the desired direction.

The flange 3 of the housing 1 of the present apparatus is provided flush with the swimming pool wall, i.e. the entire apparatus is disposed within the swimming pool wall and therebehind. Only the space surrounded by the inner peripheral surface of the housing 1 is open toward the swimming pool.

A housing element 8 containing flange means is disposed within the interior 28 of the housing 1 and sealingly abuts the inner shoulder 4 of said housing. The housing insert 8 is also substantially cylindrical. An annular intake space 23 is formed between the sidewall of the housing insert 8 and the inner wall of the housing 1. The water flows from the swimming pool and the interior 28 of the housing 1 via the intake space into the suction chamber 24 of the housing insert 8. The suction chamber is separated from the pressure chamber 25 of the housing insert 8 via a partition 12. The housing insert 8 is connected by its flange with the inner shoulder 4 of the housing 1 by means of screws 9. In this connection, screws 10, disposed in plastic sleeves, can suitably be additionally provided which join the bottom 5 of the housing 1 to the front wall 11 of the housing insert 8.

In the illustrated embodiment, nozzles 15 which are spaced apart from one another are disposed in the front wall 11 of the housing insert 8, the angles of delivery of these nozzles being adjustable by a ball-and-socket joint arrangement. The housing insert 8 is installed at such a depth within the housing 1 that the mouth portions of the nozzles 15 are in alignment with the boundary plane formed by the flanges 3. Thus, the ends of the nozzles do not project from the housing 1 into the swimming pool. For feeding compressed air into the nozzles 15, compressed-air lines 16 are provided which are sealingly connected at the parting line between the housing insert 8 and the housing 1 and/or the inner shoulder 4 by means of gaskets 17.

The suction chamber 24 of the housing insert 8 has a web 13 on its front face, said web projecting at right angles to the partition 12 from the front wall 11 and forming a wall web 14 extending substantially parallel to the wall of the housing 1. The wall web 14 terminates in a flange which is connected with the inner shoulder 4 of the housing 1 by means of a screw 9. The spacing of the wall web 14 from the inner wall of the housing 1 corresponds to the width of the annular intake space 23, said intake space terminating into the suction chamber 24 in the region between the partition 12 and the web 13 and/or wall web 14. The housing insert 8 is covered at its front end by a circular cover plate 22, shown in FIG. 3, which is arranged at a distance from the front wall 11, said cover plate having corresponding apertures 35 for the penetration of the nozzles 15. Because of the positioning of the cover plate 22, a direct access from the front end to the suction chamber 24 is prevented in the open zones. Water can flow to the suction to the suction chamber 24 in the gap between the cover plate 22 and the front wall and/or the web 13 through the intake space 23. Because the entire cross section of the flow channel for the water flowing to the suction chamber 24, as well as the opening of the suction chamber defined by the webs 13 and 14 and the partition 12, is so large, the flow velocity of the water entering the housing space 28 and the suction chamber 24 is very low and thus no significant suction power exists at any location. Excessive suction power can be dangerous, i.e., it exerts so much suction on body parts, for example hands, that a detachment is painful and difficult. The pressure flow produced by the nozzles is not at all affected by this slow velocity of the water entering the suction chamber. This means that the effect of the water jet emanating from the nozzles 15 is fully utilized, since it is unnecessary to overcome an oppositely directed suction flow.

In opposition to the mouth of the pressure nipple 6, a plate 18 is disposed which is mounted on a threaded rod disposed at right angles thereto and is movable back and forth by the operation of the threaded rod in the axial direction toward and away from the mouth of the pressure nipple 6. The arrangement is such that the plate 18 cannot close off the mouth orifice of the pressure nipple 6 entirely. The threaded rod 19 which is held in the front wall 11 penetrates the cover plate 22, and has an adjusting knob 20 which can be actuated from the swimming pool. Thus, the desired force of the water current emanating from the nozzles 15 can be adjusted directly from the side of the swimming pool.

Underneath the nozzles 15, a key (push button) is arranged centrally at the cover plate 22, above the web. By means of this key, a switch 21 underneath the web 13 can be actuated. From the switch 21, a cable 31 carrying weak current extends to a switching unit. By means of the switch and key 21, the device can be switched on and off from the water.

In operation, when the switch 21 is actuated from the swimming pool, the pump is activated via the weak current carrying cable 31. Due to the suction effect of the pump, the water flows from the swimming pool into the housing 1, which is open toward the swimming pool and into the annular intake space 23. The space 23 is in communication with the suction chamber 24 below the nozzles by apertures provided in the sidewall of the housing insert 8. From the suction chamber, the water is drawn through the suction nipple 7 and the conduit 32 and into the pump 33. From the pump, the water taken in from the swimming pool is conveyed through the conduit 32 into the pressure nipple 6 and from there into the pressure chamber 25, which is separated from the suction chamber 24 by the partition 12. From the pressure chamber 25, the water flows into the nozzles 15, as shown in FIG. 6, from which it is discharged under pressure into the water of the swimming pool to produce the desired current. Due to the large intake cross section, the velocities of the intake water surrounding the pressure water jet are very minor, so that an impairment of the pressure flow from the nozzles, as well as an endangering of the persons due to a large suction effect are eliminated.

If it is intended to admix air with the water discharged from the nozzles 15, the conduit 16 which terminates in the nozzle duct is connected to a source of compressed air which can be regulated with respect to the compressed air feed from outside the swimming pool. By an injector effect in the nozzles 15, it is also possible to take in air from the atmosphere via conduit 16, without the use of a compressed-air source. The relationship between pressure chamber 25, conduit 16 and nozzles 15 are clearly shown in FIG. 6. In the illustrated embodiment, and as particularly shown in FIG. 7, it can be seen that the pressure chamber 25 is larger than the suction chamber 24. Due to the large intake cross section, a quiet and slow intake flow of the water from the swimming pool is obtained which does not interfere with the pressure (delivery) flow. Because of the large pressure chamber 25, the occurrence of a pressure drop between the pressure nipple 6 and the nozzle 15 is avoided.

Figure 5:
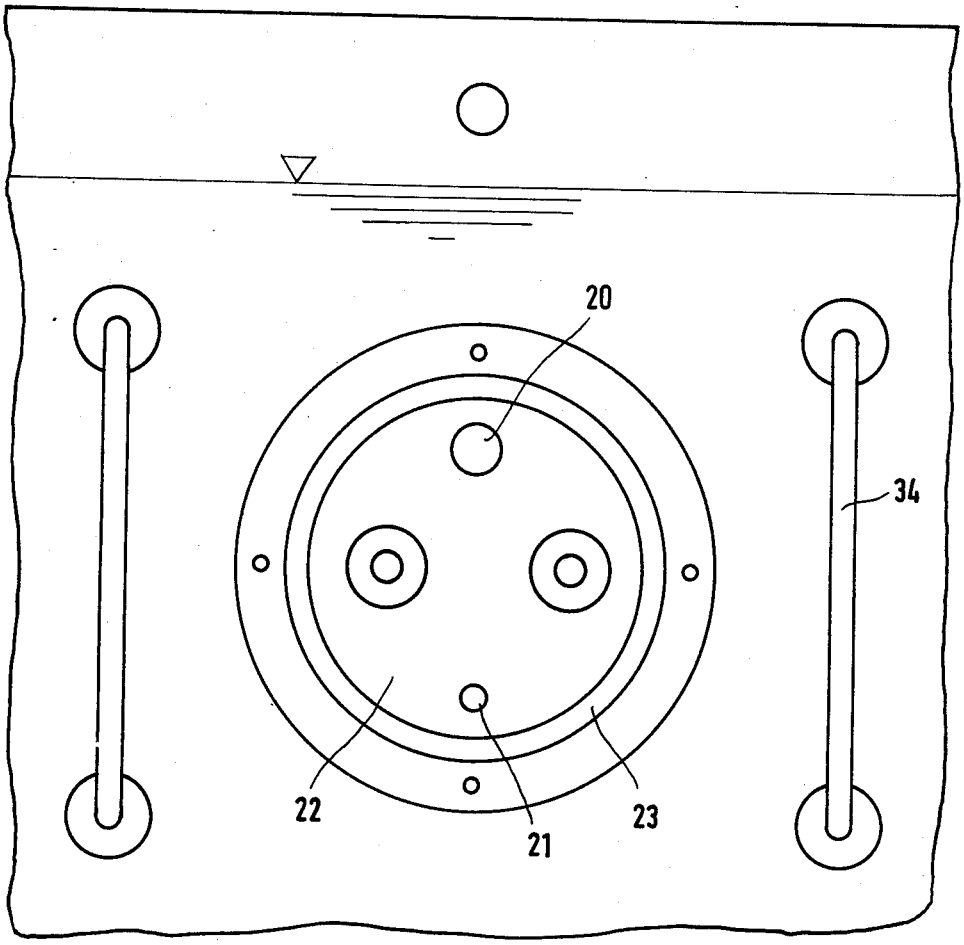
FIG. 5 shows handles attached to the outer housing rim of the water-current producing device.

The housing 1 of the illustrated embodiment is suitably mounted in the wall 26 of the swimming pool in such a manner that the suction chamber 24 is below the nozzles 15, said nozzles being arranged in a horizontal plane beneath the water level. In place of the two nozzles 15, which can be individually turned off and which are adjustable by a ball-and-socket joint, it is also possible to provide several nozzles, or only a single nozzle. If a single nozzle is used, it is advantageously disposed in a central position. Handles 34 as shown in FIG. 5 can be provided at the flange 3, so that it is more readily possible to actuate the adjusting knob 20 or the switch 21 from the water to provide a strong flow.

The invention being thus described, it will be obvious that the same may be varied in many ways. Such variations are not to be regarded as a departure from the spirit and scope of the invention and all such modifications are intended to be included within the scope of the following claims.

It is claimed:

1. An apparatus for producing a water current in a swimming pool which comprises an outer housing which is adapted to be mounted in the wall of a swimming pool, said outer housing being provided with a suction nipple and a pressure nipple, a housing insert disposed within the outer housing, said housing insert having a side wall which defines an annular intake space between the outer housing and the interior of the housing insert, partition means associated with the housing insert, said partition means subdividing the interior of said housing insert into a pressure chamber and a suction chamber having a front side and lateral side, a pump means having a pressure side and a suction side which communicates with the pressure chamber and the suction chamber, respectively, said pressure chamber containing a front wall, at least one nozzle means disposed in said front wall, said suction chamber containing open sections in the lateral side thereof, said pressure chamber being disposed between the pressure nipple and the nozzle means, said suction chamber being disposed between the suction nipple and the annular intake space, said annular intake space communicating with the interior of the swimming pool and the suction chamber by means of an intake opening disposed in the side wall of the suction chamber, the through-flow cross section of the intake opening being sufficiently large to produce a low velocity in the intake flow so that no significant suction power exists.

2. The apparatus of claim 1, wherein the housing is substantially cylindrical and the annular intake space is limited on the side opposite the swimming pool by an inner shoulder provided in the outer housing.

3. The apparatus of claim 2, wherein on the swimming pool side the outer housing ends in a terminal rim and the housing insert is seated within the interior of the outer housing such that the mouth of the nozzle projecting from the housing insert is in the same plane as said terminal rim.

4. The apparatus of claim 3, wherein handle means are attached to the outer housing rim in the swimming pool.

5. The apparatus of claim 2, wherein the suction chamber is defined by the partition means and a web means which contains open sections, said web means extending into a web wall means lying in the side wall plane of the housing insert, said web wall terminating in a flange which is adapted to be attached to the inner shoulder of the outer housing.

6. The apparatus of claim 1, wherein means are provided for infinitely varying the cross section of the orifice of the pressure nipple in a location where said pressure nipple communicates with the pressure chamber, said means being unable to completely close said orifice.

7. The apparatus of claim 6, wherein the means for infinitely varying the cross section of the orifice is a plate means which is disposed opposite to the orifice of the pressure nipple and adjusting means for varying the distance of the plate means from the orifice, said adjusting means comprising a threaded rod containing an adjusting knob mounted in the front wall of the outer housing and extending through an opening in the cover plate means.

8. The apparatus of claim 7, wherein the pressure chamber is larger than the suction chamber.

9. The apparatus of claim 8, wherein two spaced-apart nozzle means are utilized and wherein means are provided for selectively actuating the nozzle means either individually or together.

10. The apparatus of claim 9, wherein compressed air line means communicate with said nozzle means, said compressed air line means sealingly extending through the pressure chamber.

11. The apparatus of claim 1, wherein a cover plate means surrounds the nozzle means and is spaced apart from the front wall of the housing insert, said cover plate means also covering the open sections of the suction chamber on both sides of the web means.

* * * * *